US008092618B2

(12) United States Patent
Sharpe et al.

(10) Patent No.: US 8,092,618 B2
(45) Date of Patent: Jan. 10, 2012

(54) SURFACE PASSIVATION TECHNIQUE FOR REDUCTION OF FOULING

(75) Inventors: Ron Sharpe, Lymington (GB); Christopher Russell, Hythe (GB); Simon Crozier, Southampton (GB)

(73) Assignee: Nalco Company, Naperville, IL (US)

( * ) Notice: Subject to any disclaimer, the term of this patent is extended or adjusted under 35 U.S.C. 154(b) by 169 days.

(21) Appl. No.: 12/582,996

(22) Filed: Oct. 21, 2009

(65) Prior Publication Data

US 2011/0088729 A1 Apr. 21, 2011

(51) Int. Cl.
*C23C 28/00* (2006.01)

(52) U.S. Cl. ..... 148/256; 148/253; 148/257; 148/259; 106/14.12; 106/14.13

(58) Field of Classification Search ..... 148/253, 148/256–257, 259; 106/14.12, 14.13
See application file for complete search history.

(56) References Cited

U.S. PATENT DOCUMENTS

| | | | | |
|---|---|---|---|---|
| 3,522,093 | A | 7/1970 | Woolman | |
| 3,977,912 | A * | 8/1976 | Smadja et al. | 148/250 |
| 4,024,050 | A | 5/1977 | Shell et al. | |
| 4,582,543 | A * | 4/1986 | Bretz | 148/250 |
| 5,855,695 | A * | 1/1999 | McMillen et al. | 148/247 |
| 6,228,253 | B1 | 5/2001 | Gandman | |

OTHER PUBLICATIONS

ASTM A-967: Standard Specification for Chemical Passivation Treatments for Stainless Steel Parts.
ASTM A-380: Standard Practice for Cleaning, Descaling, and Passivation of Stainless Steel Parts, Equipment, and Systems.
Babaian-Kibala et al., "Stream analysis, failure analysis and laboratory tests show effect of hydrogen sulfide and phosphorous-based inhibitors," *Fuel Reformulation*, vol. 4 (1), 1994, pp. 43-48.
Sorochenko et al., "Comparative characteristics of phosphate-containing inhibitors for neutral media," Politekh. Inst., Kiev, *Ukraine. Neftepererabotka i Neftekhimiya*, Naukova Dumka , Kiev, 1993, vol. 44, pp. 82-89, with English abstract.

* cited by examiner

*Primary Examiner* — Roy King
*Assistant Examiner* — Lois Zheng
(74) *Attorney, Agent, or Firm* — Benjamin E. Carlsen; Michael B. Martin

(57) ABSTRACT

The invention provides a method and apparatus for controlling the formation of foulant deposits on petroleum processing equipment. The invention involves a first mixture comprising an acid phosphate ester. The first mixture is applied to the surface of the petroleum processing equipment at a high temperature. Then a second mixture comprising a metal salt is applied also at a high temperature. The result is sufficient to provide an effective coating that prevents the formation of foulant deposits on the petroleum processing equipment. The second mixture reacts with any polyphosphate in the coating to prevent any contamination of petroleum materials within the petroleum processing equipment.

6 Claims, 6 Drawing Sheets

SURFACE PASSIVATION TECHNIQUE FOR REDUCTION OF FOULING

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to compositions of matter and methods of using them for passivating various industrial process equipment, in particular certain compositions that have been found to be particularly effective in reducing the deposition of foulants in petroleum processing equipment.

Passivation is the process of making a material "passive" (non-reactive) in relation to another material prior to using the two materials together. Some examples of passivation are described in U.S. Pat. Nos. 4,024,050, 3,522,093, 6,228,253, ASTM A-967, and ASTM A-380. In the context of petroleum processing equipment, one common method of passivating the equipment is phosphate passivation. Phosphate passivation involves coating the surface of the equipment with a layer of phosphates that prevents reactions between the petroleum materials the equipment walls. Two known methods of phosphate passivation are amine neutralized phosphate ester treatment and acid phosphate ester treatment such as that described in articles: *Comparative characteristics of phosphate-containing inhibitors for neutral media*, by V F Sorochenko et al., Politekh. Inst., Kiev, Ukraine. Neftepererabotka i Neftekhimiya (Kiev) (1993), volume 44 pages 82-89 Publisher: Naukova Dumka, and *Stream analysis, failure analysis and laboratory tests show effect of hydrogen sulfide and phosphorous-based inhibitors*, by Babaian-Kibala et al., Fuel Reformulation (1994), Volume 4(1), pages 43-48. Although both of these methods produce an iron phosphate coating, each has drawbacks. The amine neutralized phosphate ester treatment produces a thin film, which unfortunately deteriorates quickly. The acid phosphate ester treatment may result in a reactive polyphosphate coating, which reacts with sodium and calcium cations in the petroleum material that promotes unwanted coke formations.

Thus there is clear need and utility for an improved method of passivating industrial process equipment used in processing petroleum material. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment of the invention is directed towards a method for passivating the surface of petroleum processing equipment. The method comprises the steps of: applying a first mixture to the surface at a temperature of at least 100° C., and applying a second mixture at a temperature of at least 100° C. after the first mixture has been applied. The first mixture comprises an acid phosphate ester that forms a complex iron polyphosphate layer. The second mixture comprises a metal salt. Application of both mixtures requires inert carrier oil. The metal salt may be selected from the list consisting of carboxylase salt, sulphonate salt, and any combination thereof. The metal salt may be selected from the list consisting of zirconium octoate, titanium octoate, vanadium octoate, chromium octoate, niobium octoate, molybdenum octoate, hafnium octoate, tantalum octoate, tungsten octoate and any combination thereof. The metal salt may comprise a metal selected from the list consisting of zirconium, titanium, vanadium, chromium, niobium, molybdenum, hafnium, tantalum, tungsten, and any combination thereof. The method may further comprise the step of alternatingly applying additional amounts of at least one of the first and second mixtures. The method may further comprise the step of conducting a petroleum material process for a duration of time shorter than the induction time of a foulant that results from the petroleum material process in the presence of the passivated surface.

At least one embodiment of the invention is directed towards a method of passivating the surface of petroleum processing equipment comprising the steps of: applying a phosphate ester treatment to the surface, and reducing the presence of polyphosphate on the surface by reacting the polyphosphate with a metal salt.

BRIEF DESCRIPTION OF THE DRAWINGS

A detailed description of the invention is hereafter described with specific reference being made to the drawings in which:

FIG. 1 is a plot graph illustrating the factors used to calculate the severity of a reaction the inventive method and apparatus are used in.

FIG. 2 is a plot graph illustrating the fouling that occurs in various reaction severities that inventive method and apparatus are used in.

DETAILED DESCRIPTION OF THE INVENTION

Figure 1:
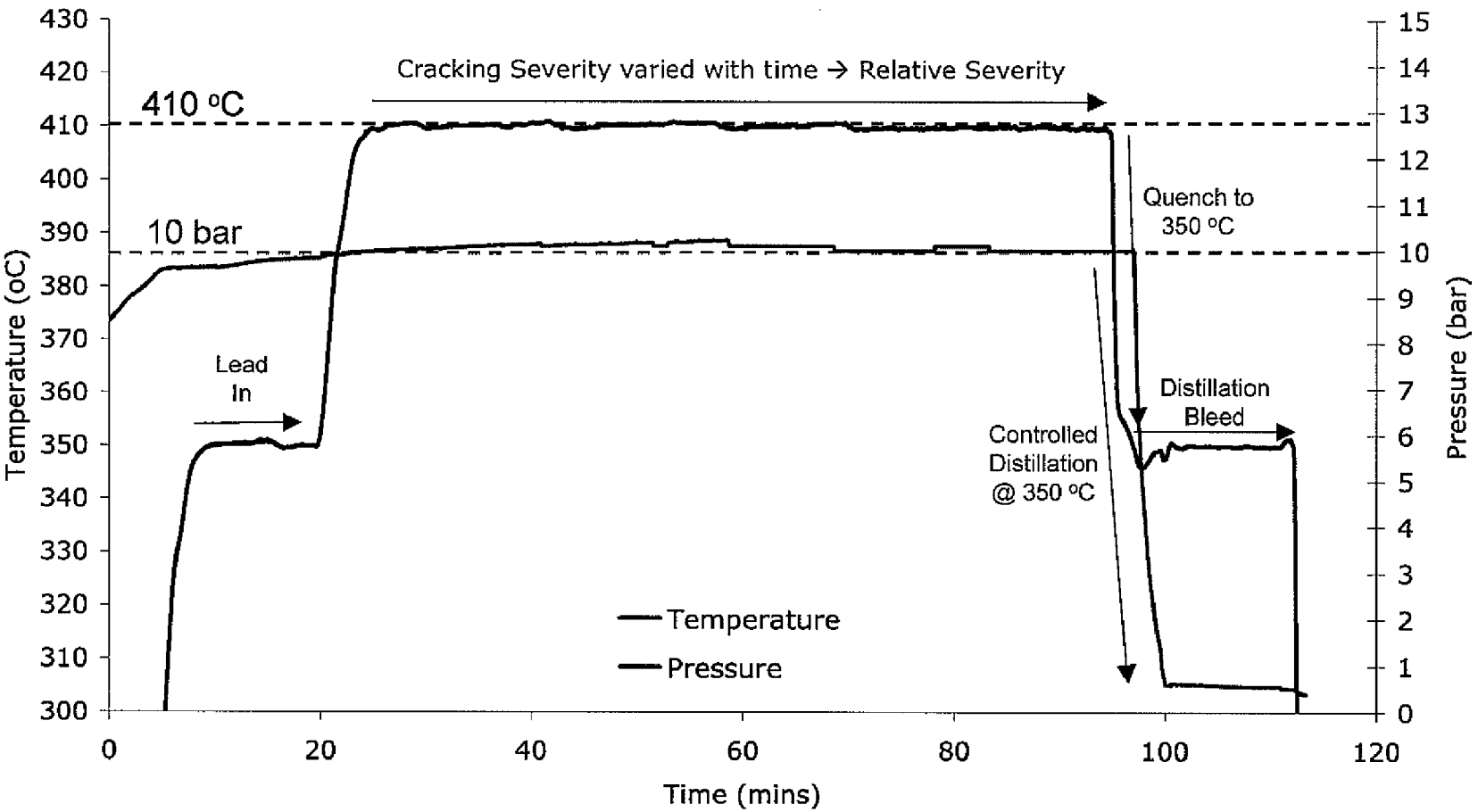

For purposes of this application the definition of these terms is as follows:

"Foulant" means a material deposit that accumulates on equipment during the operation of a manufacturing and/or chemical process which may be unwanted and which may impair the cost and/or efficiency of the process and includes but is not limited to asphaltene and coke.

"Passivation" means the prevention of a reaction between two materials when used together by cleaning and/or coating at least one of the two materials to such an extent that they become substantially less reactive relative to each other.

"Petroleum material" means petroleum, petroleum fractions including residues, and or crude oil, and the like.

"Petroleum processing equipment" means equipment used to refine, store, transport, fractionate, or otherwise process a petroleum material including but not limited to fired heaters, heat exchangers, tubes, pipes, heat transfer vessels, process vessels, and tanks.

"Petroleum material process" means an industrial process performed on petroleum material including but not limited to refining, storing, transporting, fractionating, or otherwise industrially affecting a petroleum material.

In the event that the above definitions or a definition stated elsewhere in this application is inconsistent with a meaning (explicit or implicit) which is commonly used, in a dictionary, or stated in a source incorporated by reference into this application, the application and the claim terms in particular are understood to be construed according to the definition in this application, and not according to the common definition, dictionary definition, or the definition that was incorporated by reference.

In at least one embodiment, a process passivates the surface of petroleum processing equipment by coating it with a modified metal phosphate coating. The modified metal phosphate coating prevents fouling from deposited coke, asphaltenes, or other foulants. The modified metal phosphate coating is produced in a two-stage process. In the first part of the passivation process, the surface of petroleum processing equipment is treated at a high temperature with a first mixture. The first mixture comprises an acid phosphate ester diluted in carrier oil which forms a complex layer with metal process wall surfaces that includes iron polyphosphate groupings. This complex layer covers the equipment surface. After the first stage is complete a second mixture is applied.

After the first mixture, the surface of petroleum processing equipment is treated at a high temperature with a second mixture. The second mixture comprises metal salt diluted in carrier oil. In at least one embodiment the metal salt is one selected from the list consisting of: carboxylate salt, sulphonate salt, and any combination thereof. When the metal in the salt reacts with the poly-phosphate a metal phosphate coating forms. Repeated alternating applications of the first and second mixtures can be used to increase the thickness of the metal coating to a desired level. In at least one embodiment the second mixture comprises a metal carboxylate salt selected from the list consisting of zirconium octoate, titanium octoate, vanadium octoate, chromium octoate, niobium octoate, molybdenum octoate, hafnium octoate, tantalum octoate, tungsten octoate and any combination thereof. In at least one embodiment the high temperature is at least 250° C.

In at least one embodiment, the resulting metal phosphate coating comprises both metal phosphates and metal oxides. Without being limited to theory it is believed that the first step produces polyphosphate, which then undergoes further reaction in the second step. The applied metal salt forms both metal phosphate and metal oxide and greatly reduces the amount of polyphosphate that can react with cations in the petroleum material. As a result a coating that is both thick and which does not contaminate the petroleum material results.

The modified metal phosphate coating imparts a number of advantages to the petroleum processing equipment. By reducing interactions between the equipment walls and petroleum materials corrosion and contamination is greatly reduced. In addition, foulants do not adhere well to the coating thereby preventing the formation of obstructions and blockages in process flow. In addition by preventing foulant buildup spalling processes and chemical dispersions can be conducted more efficiently.

EXAMPLES

The following examples are presented to describe embodiments and utilities of the invention and are not meant to limit the invention unless otherwise stated in the claims.

Methodology

A number of metal mesh reactor inserts were placed within a reactor. The metal inserts simulated metal surfaces of industrial petroleum processing equipment. The inserts had the modified metal phosphate coating applied according to the two-step process. Within the reactor a pyrolysis reaction was then conducted to simulate the environment that would be present in industrial petroleum processing equipment. The inserts were then removed from the reactor and washed with solvents of increasing polarity. Residual deposits of (any) hard coke foulant deposits were then measured.

Because a variety of environments can be envisioned in which the invention would be applicable, a methodology of quantifying the severity of the pyrolysis reaction was performed. The quantification was performed by manipulation of the Arrhenius Law by assuming average activation energies and pre-exponential factors taken from literature values. Reaction rate constants were obtained for each time segment (second) at the cracking temperature (410° C.). The sum of the rate constants was used to measure the severity of the pyrolysis reaction that is dependent on the particular parameters of a particular reaction.

Figure 2:
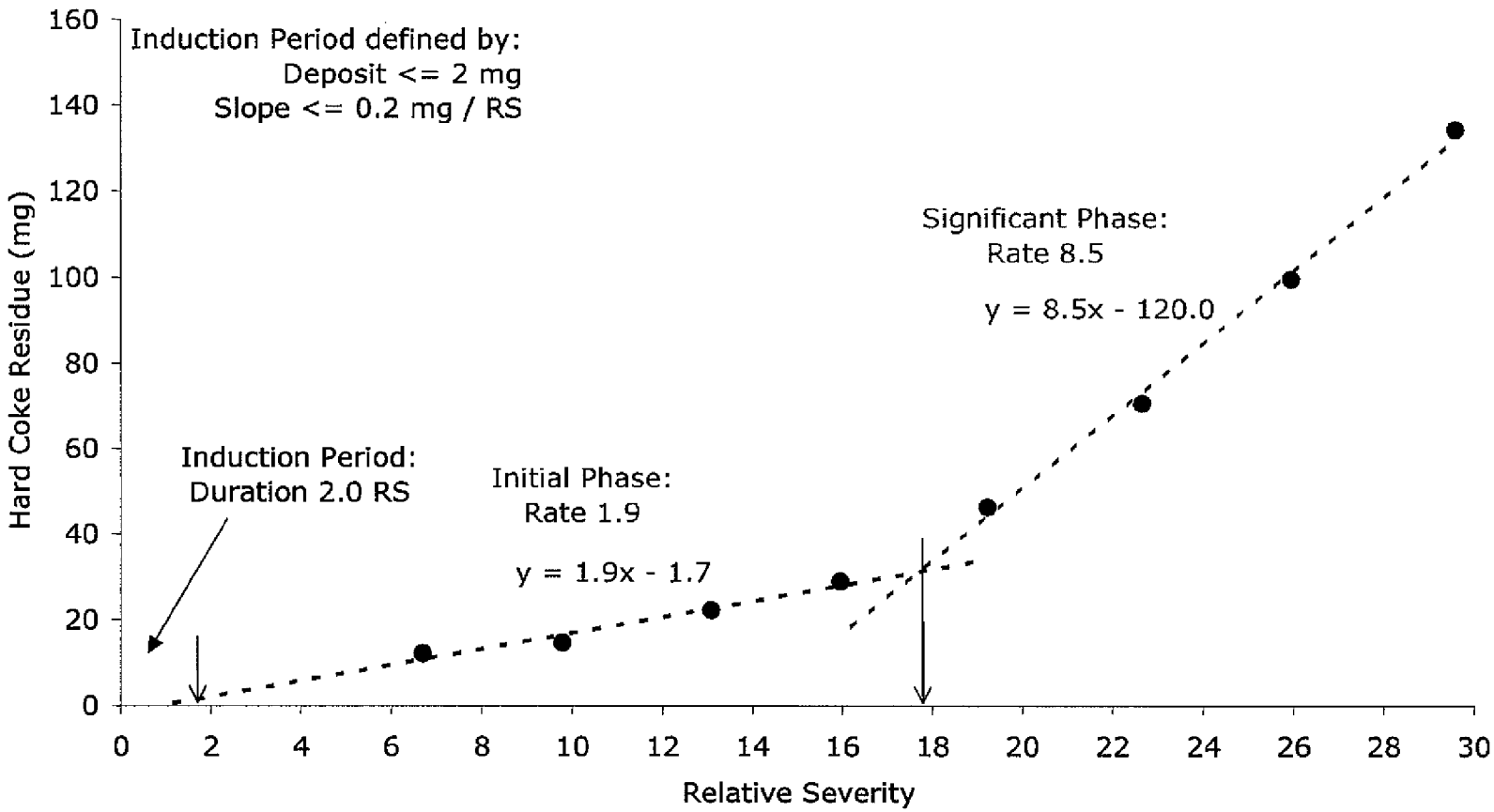

FIG. 1 is a graph illustrating the progress of temperature and pressure of a particular pyrolysis experiment. The conditions in the reaction were steady and reproducible and can be correlated to a particular severity. As a result a direct relationship of foulant to severity could be obtained. FIG. 2 illustrates the degree of fouling that occurs for various severities of a particular pyrolysis reaction ranging between a severity of 1 and 30.

Figure 3:
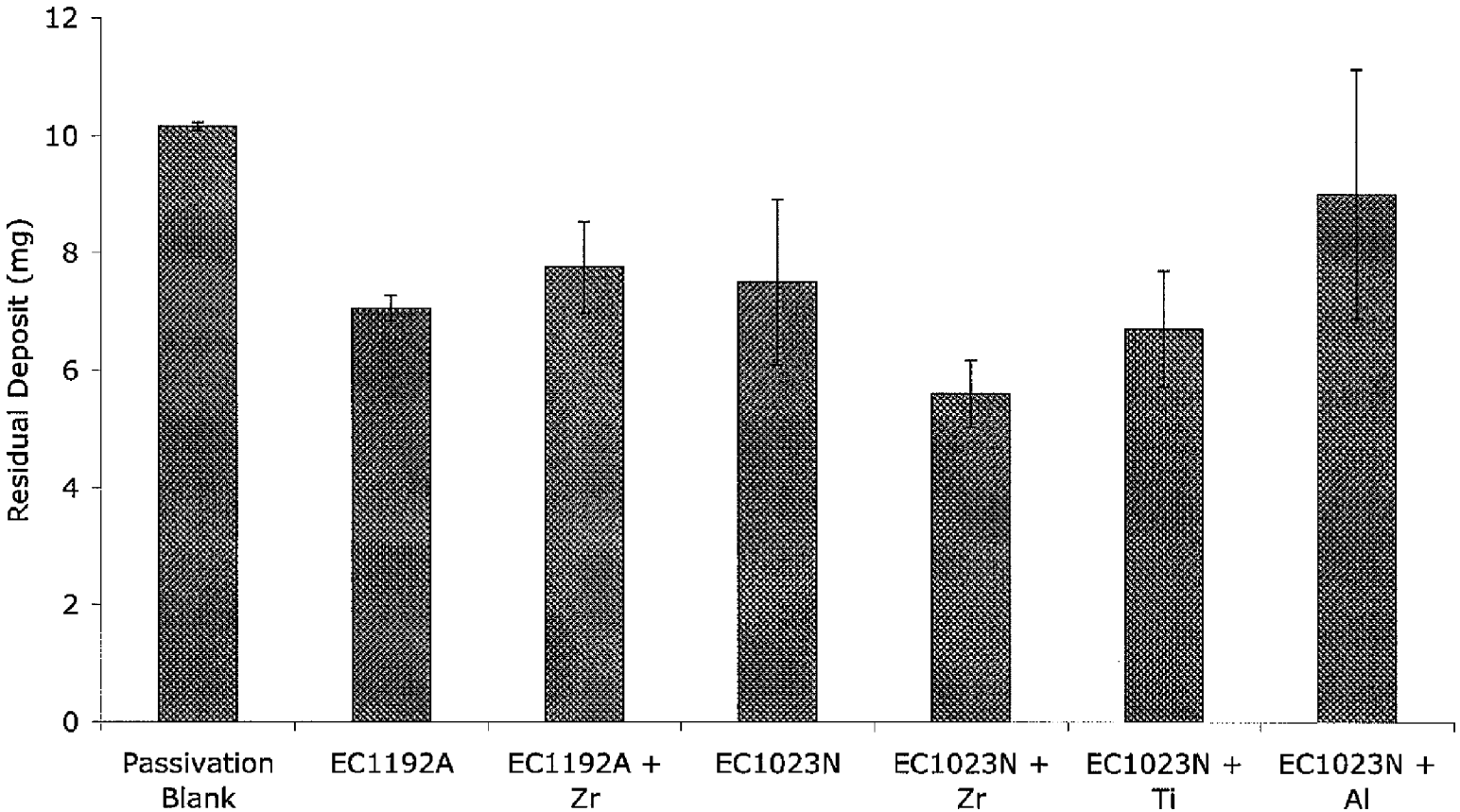
FIG. 3 is a bar graph illustrating the degree of foulant reduction that the inventive method and apparatus and the prior art methods provide.

Data:

A number of phosphate passivation techniques were performed at a severity of 16. This level of severity is one that is severe enough to make positive result apparent while not so severe as to overwhelm the phosphate passivation. The results are shown on FIG. 3. While prior art phosphate esters such as amine neutralized alkyl phosphate esters and un-neutralized alkyl phosphate esters both provide a 30% drop in foulant deposit, the use of a second step having a mixture which include a metal salt results in a drop in foulant deposit of more than 30%. When the metal salt included Ti the drop was 34% and when the metal salt included Zr the drop was 45%.

Figure 4A:
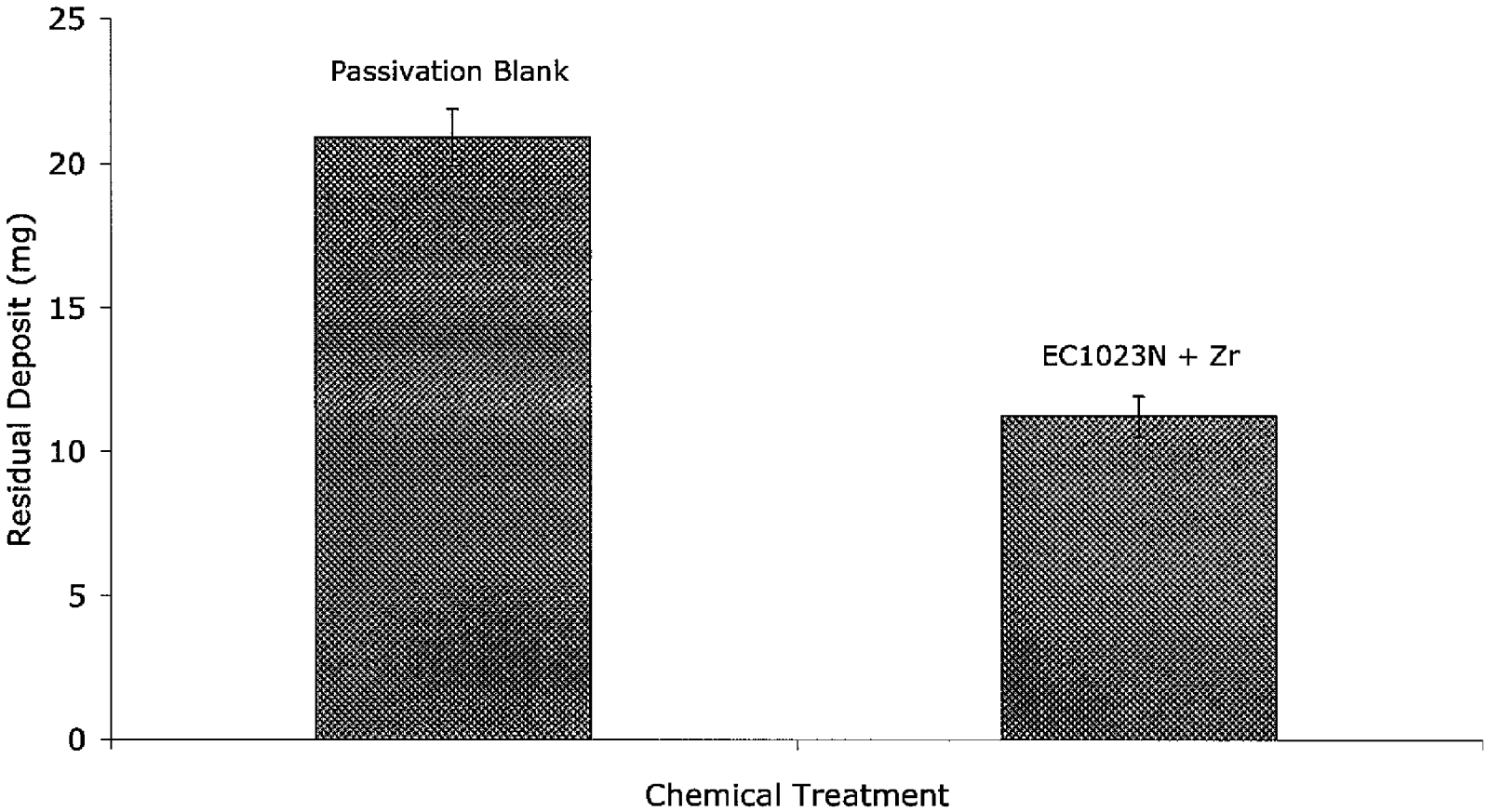
FIGS. 4A and 4B are bar graphs illustrating the degree of foulant reduction that one inventive method and apparatus and one prior art method provide.
Figure 4B:
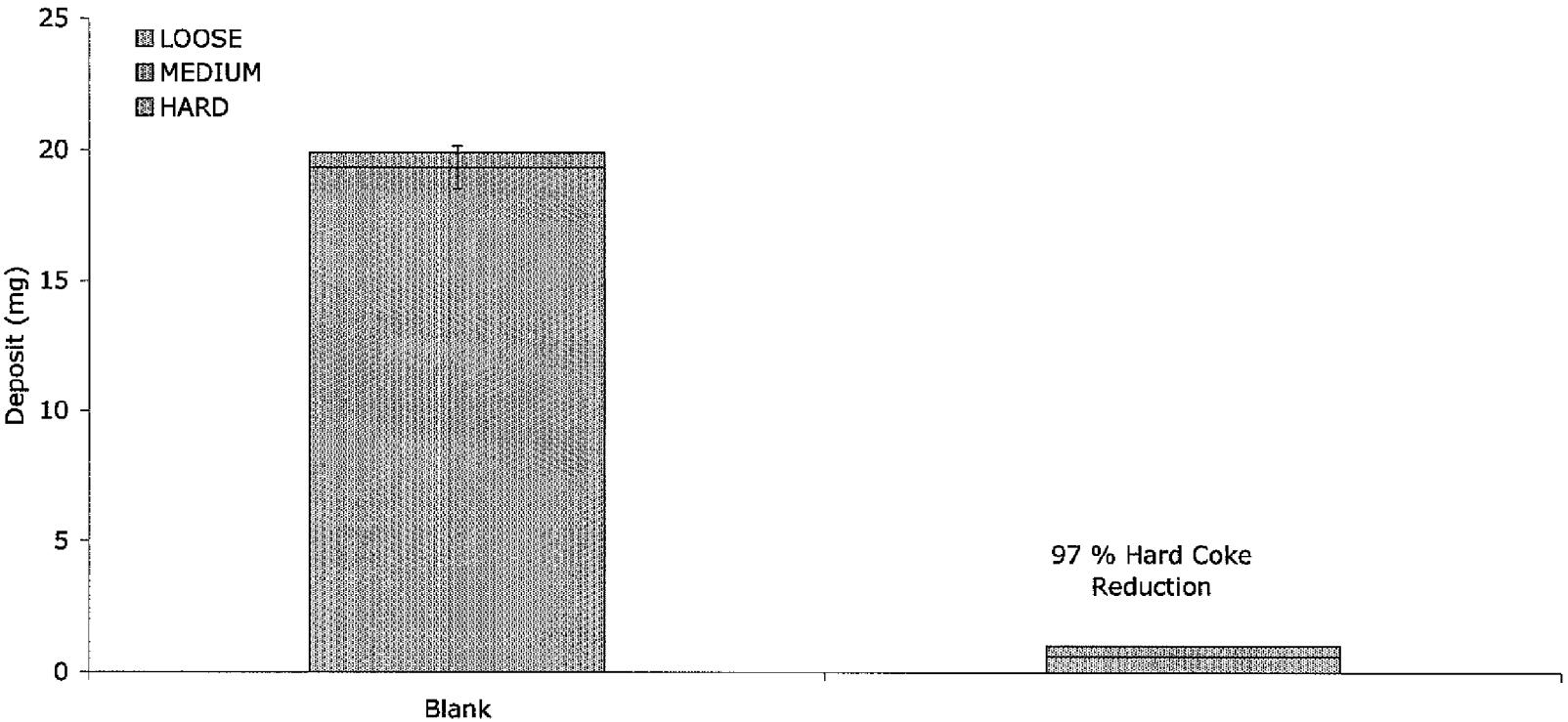

FIG. 4A illustrates phosphate passivation techniques performed at a severity of 13. At this severity, the inventive two-step passivation using a Zr metal salt was twice as effective as the prior art acid phosphate ester technique. FIG. 4B reveals an even greater reduction in residual surface deposit using the two-step passivation technique. Although performed at a slightly lower severity (390 deg C. for 40 minutes), there is a 97% reduction in surface deposit relative to blank conditions.

Figure 5:
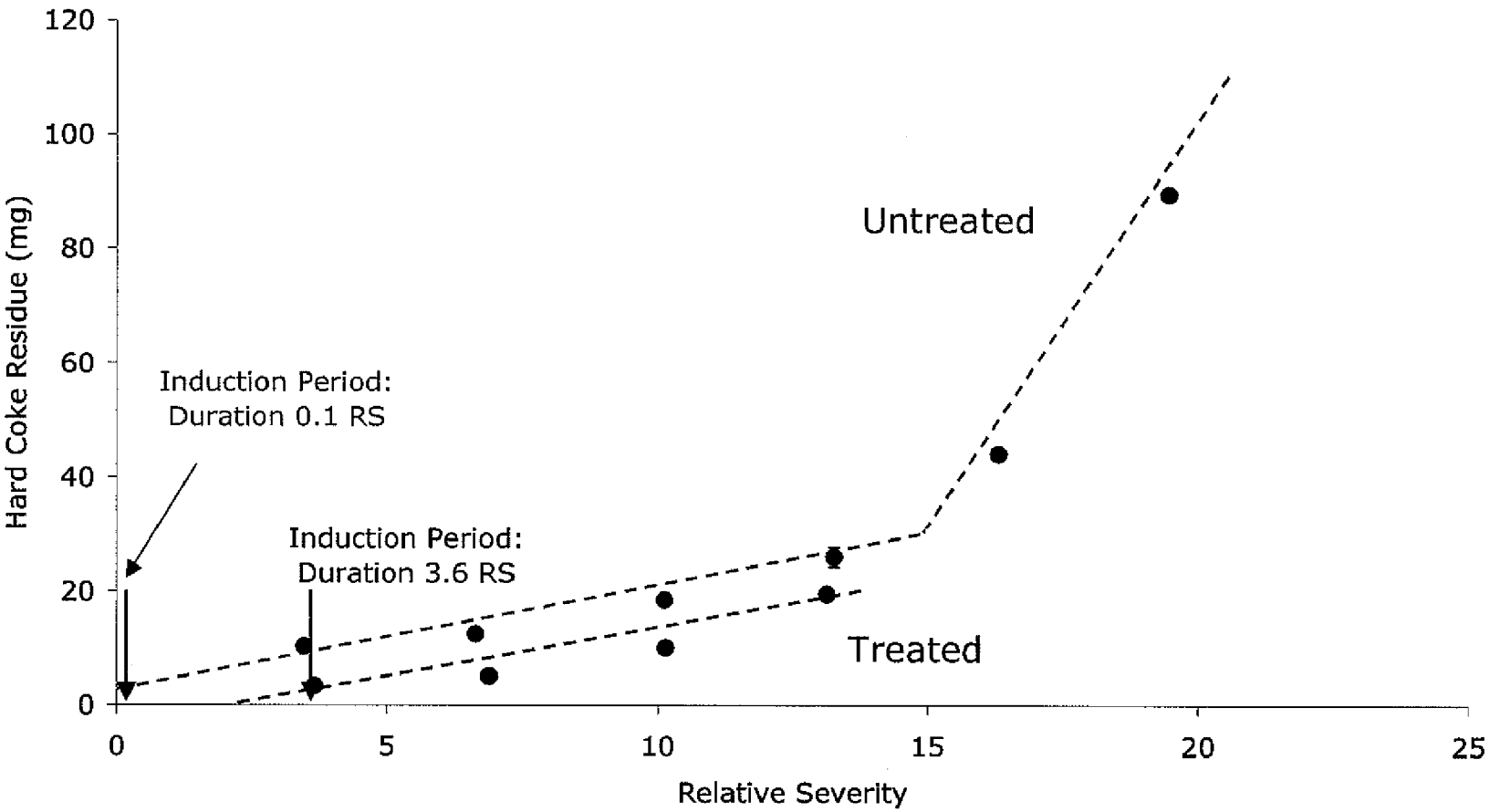
FIG. 5 is a plot graph illustrating the fouling that occurs in various reaction severities of both the inventive method and apparatus and the prior art method.

FIG. 5 illustrates a comparison of the inventive two-step passivation technique using a Zr metal salt and acid phosphate ester technique with untreated surface over a number of seventies. The data provides two revelations. First the inventive two-step technique consistently results in less fouling regardless of the severity. Second the inventive two-step technique increases the induction time of the foulant reaction. As a result, reactions run in equipment passivated by the inventive two-step technique can have substantially no foulant if run for a period of time shorter than the extended induction time.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and other referenced materials mentioned herein are incorporated by reference in their entirety. Furthermore, the invention encompasses any possible combination of some or all of the various embodiments described herein and incorporated herein.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), end ending with a maximum value of 10 or less, (e.g. 2.3 to 9.4, 3 to 8, 4 to 7), and finally to each number 1, 2, 3, 4, 5, 6, 7, 8, 9, and 10 contained within the range.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for passivating a surface of petroleum processing equipment comprising the steps of:

applying a first mixture to a surface at a temperature of at least 100° C., and applying a second mixture at a temperature of at least 100° C. after the first mixture has been applied, wherein the first mixture comprises an acid phosphate ester which forms a complex polyphosphate layer, and the second mixture comprises a metal salt, wherein the metal salt is a carboxylate salt selected from the group consisting of zirconium octoate, titanium octoate, vanadium octoate, chromium octoate, niobium octoate, molybdenum octoate, hafnium octoate, tantalum octoate, tungsten octoate and any combination thereof.

2. The method of claim 1 wherein the first mixture further comprises a carrier oil.

3. The method of claim 1 wherein the second mixture further comprises sulphonate salt.

4. The method of claim 1 wherein the metal salt is zirconium octoate.

5. The method of claim 1 further comprising a step of alternatingly applying additional amounts of at least one of the first and second mixtures.

6. The method of claim 1 further comprising a step of conducting a petroleum material process for a duration of time shorter than the induction time of a foulant that results from the petroleum material process in the presence of the passivated surface.

* * * * *